United States Patent [19]

Petzold et al.

[11] Patent Number: 4,933,220

[45] Date of Patent: Jun. 12, 1990

[54] METHOD OF SEAM COATING FLOORING

[75] Inventors: James R. Petzold, Lancaster; Albert C. Weidman, East Petersburg, both of Pa.

[73] Assignee: Armstrong World Industries, Inc., Lancaster, Pa.

[21] Appl. No.: 286,388

[22] Filed: Dec. 19, 1988

[51] Int. Cl.[5] ..... B32B 3/10; B32B 3/08; B05D 5/00

[52] U.S. Cl. ..... 428/61; 428/58; 427/256

[58] Field of Search ..... 428/58, 61; 427/256

[56] References Cited

U.S. PATENT DOCUMENTS 4,781,987 11/1988 Bolgiano et al. ..... 428/480

FOREIGN PATENT DOCUMENTS 0239890 10/1987 European Pat. Off. .

*Primary Examiner*—Alexander S. Thomas

[57] ABSTRACT

The seam of a surface covering product, having an exposed surface which is the reaction product of a protective coating composition including an aminoplast and a polyol, is coated with a seam coating composition including a cyanoacrylate monomer and a plasticizer. The preferred monomer is methyl 2-cyanoacrylate, ethyl 2-cyanoacrylate or methoxy ethyl 2-cyanoacrylate. The preferred plasticizer is dibutyl phthalate. The seam coating should have a viscosity of about 100 CPS. An accelerator may be applied to the uncured seam coating.

29 Claims, No Drawings

METHOD OF SEAM COATING FLOORING

FIELD OF THE INVENTION

The invention relates to a method of seam coating resilient sheet flooring. In particular, the invention is directed to a method of seam coating a resilient sheet flooring having a highly crosslinked wear surface, and more specifically, a wear surface which is the reaction product of a composition comprising a polyol and aminoplast.

BACKGROUND OF THE INVENTION

A highly crosslinked wear surface formed by the reaction of a composition comprising a polyol and an aminoplast has been developed which has excellent scratch and stain resistance. However, since the surface of the highly crosslinked wear layer has only a trace amount of reactive functional groups, it has been extremely difficult to discover a composition which will adhere to the wear layer and which can be used as a seam coating.

As known in the art, when two sections of resilient sheet flooring are laid with two edges abutting, a seam is formed. Unless the seam is coated with a sealing composition, dirt tends to accumulate in the seam, and due to the slight difference in surface height between the two sections of resilient flooring at the seam, traffic will tend to snag the higher surface. A seam coating eliminates the crevice at the abutment and smooths the transition between the two elevations at the abutment.

Numerous seam coating compositions are known. Further a cyanoacrylate adhesive with dibutyl phthalate plasticizer is disclosed in European patent application Ser. No. 239,890. The invention of the European Application is an opaque cyanoacrylate adhesive or coating composition which comprises a monomeric ester of 2-cyanoacrylic acid and 5 to 50% by weight, based on the monomeric ester, of a semi-compatible plasticizer. The European application compares the opaque adhesive of the European invention with a non-opaque coating of cyanoacrylate with a fully compatible dibutyl phthalate plasticizer.

Since typical seam coatings would not adhere to the polyol/aminoplast wear layer, the surface was analyzed by the present inventors to determine if there were any functional groups present which could be used to gain adhesion. Only trace amounts of N—H, C—O, C=O and C—Cl were detected. Attempts to attack or soften the wear layer surface with solvents was also evaluated. The solvents were covered with watch glasses to retard evaporation. Of the nine solvents tested, only methylene chloride, tetrahydrofuran and methyl ethyl ketone softened and/or shriveled the surface of the wear layer within a twenty minute time period. However, if any of the above solvents were allowed to evaporate to dryness without restrictions, they had no effect on the surface of the wear layer.

Typical acrylic, nitrocellulose and vinyl lacquers utilizing these most active solvents were evaluated. The wear layer acted as a release coating and the lacquers failed to gain adhesion.

Many resinous systems including cyanoacrylates, alkyds, lacquers, epoxies, polyurethanes, and crosslinkable lattices were evaluated. The surface of the wear layer was pretreated with such agents as acids, alkali and corona discharge without improving the bonding characteristics.

One objective of the present invention is to provide a method of seam coating the surface of a wear layer comprising the reaction product of an aminoplast and a polyol.

A further object is to provide a seam coating composition which will adhere to the aminoplast/polyol wear layer and have excellent stain and scratch resistance as well as an appearance similar to the surface of the aminoplast/polyol wear surface.

These and other advantages of the present invention will become apparent from the detailed description of the preferred embodiments which follows.

SUMMARY OF THE INVENTION

It has been found that of the numerous adhesives and coating compositions for resilient floor coverings, only a coating composition comprising cyanoacrylate monomer will adhere to the surface of an aminoplast/polyol wear layer and has the desired stain and scratch resistance and appearance.

DETAILED DESCRIPTION OF THE INVENTION

U.S. Pat. No. 4,781,987, issued Nov. 1, 1988, in the names of Bolgiano et al. and U.S. application Ser. No. 945,831, filed Dec. 23, 1986 in the name of Witman disclose highly crosslinked protective coatings or wear layers comprising an aminoplast, preferably melamine, and a polyol. Both of these references are incorporated herein by reference. The compositions of the Bolgiano et al. patent and Witman application yield a protective coating for resilient flooring which has superior stain and scratch resistance. However, the surface of the wear layer has only trace amounts of N—H, C—O, C=O and C—Cl functional groups and no $NH_2$ or OH functional groups. Therefore, it has been difficult to discover a seam coating composition which will adhere to the aminoplast/polyol wear layer.

Attempts were made to soften the surface of the wear layer with a number of solvents. The solvents were covered with watch glasses to retard evaporation. Table 1 sets forth the substance and the results of the test.

TABLE 1

| Solvent Surface Treatment | |
|---|---|
| Solvent | Time for Surface Softening and/or Shriveling |
| Methylene Chloride | 4 minutes |
| Tetrahydrofuran | 12 minutes |
| Methyl ethyl ketone | 22 minutes |
| Methyl isobutyl ketone | 7 hours, slight blistering |
| Isopropanol | 7 hours, none |
| Ethanol | 7 hours, none |
| Isopropyl acetate | 7 hours, none |
| Butyl cellosolve acetate | 7 hours, none |
| Toluol | 7 hours, none |

When the above solvents are allowed to evaporate to dryness without the watch glass, they have no effect on the wear layer surface. Typical acrylic nitrocellulose and vinyl lacquers utilizing the most active solvents were evaluated by applying the lacquer to the wear layer and allowing it to air dry at room temperature. Other seam coating candidates including highly crosslinked polyurethanes were also tested. The results of these tests are set forth in Table 2.

TABLE 2

| Solvent Based Lacquers | Type | Solvent System | Adhesion and/ or Remarks |
|---|---|---|---|
| Acryloid ® A21[1] (25%) | Methyl methacrylate | MEK[2] | Poor - good iodine resistance |
| Acryloid A21/ Acryloid CS-1[1] | Methyl methacrylate/ tackifier | MEK | Poor - CS-1 lowered gloss |
| Acryloid A21/ Santicizer 160 (2.5%)[8] | Methyl methacrylate/ plasticizer | $MeCl_2$[3] | Poor |
| Acryloid B67[1] | Isobutyl methacrylate | VM&P naphtha | Good after 2 days, poor after 7 days |
| Acryloid B67 (Crumbs)[1] | Isobutyl methacrylate | MEK | Poor - easily marred |
| Acryloid B67/ Acryloid DMSS[1] | Isobutyl methacrylate | MEK | Poor - easily marred |
| Acryloid B84[1] | Methyl methacrylate | Toluene/ Sec. Butanol | Poor - poor iodine resistance |
| Acryloid B48S (45%)[1] | Methyl methacrylate | Toluene | Poor - poor iodine resis. |
| Acryloid B-99[1] | Methyl methacrylate | Toluene/ xylene | Poor - brittle good iodine resistance |
| Acryloid XR-34[1] | — | — | Poor |
| Acryloid B44[1]/VAGH[4]/DOP[5] 3/2/1/ (25%) | Acrylic/PVC[6]/ Plasticizer | $MeCl_2$/Toluol 2/1 | Poor |
| Nitrocellulose RS[7] | — | — | Poor |
| Nitrocellulose SS[7] ½ sec (40%) | — | Ethanol | Poor |
| Butvar ® 90[8] (20%) | Polyvinyl butyral | n-butanol/ MIBK 1/1 | Poor |
| Butvar ® 98[8] (15%) | Polyvinyl butyral | Toluene/ ethanol 6/4 | Poor |
| Ethyl Cellulose N7 (15%) | — | Toluol/n butanol | Poor - alcohol redissolves |
| Evlacite ® 2045[9] (15%) | Isobutyl methacrylate | MEK | Poor |
| Evlacite 2041[9] | Isobutyl methacrylate | MEK | Poor |
| Elvacite 2041[9]/ VMCH[4] (11%) | Isobutyl methacrylate/PVC | MEK/THF[10]/ DMF[11] 20/4/1 | Poor |
| Elvacite 2041[9]/ Firestone 6336[12] (11%) | Isobutyl methacrylate/PVC | MEK/THF/DMF 20/4/1 | Poor |
| Carboset ® XL-44[13] (10%) | Alkali soluble acrylics | MEK (also $NH_4OH$) | Poor |
| Carboset ® 525[13] (10%) | Alkali soluble acrylics | MEK | Poor |
| VAGH[4] (20%) | PVC/PVAC[14]/OH[15] | MEK/$MeCl_2$ 1/1 | Poor |
| VAGH[4] (25%) | PVC/PVAC/OH | cyclohexanone | Poor |
| VYES[4] (40%) | PVC/PVAC/OH | MIBK[16]/toluene 1/1 | Good - easily marred, poor U.V. |
| Mirabond ®[17] | Polyurethane | Xylene | Poor |
| Mirabond ®[17] | — | Added $MeCl_2$ (20%) | Poor |
| Securabond Adhesive[17] | Polyamide/Epoxy | — | Poor |
| VAGH[4]/THF | — | THF | Poor |
| Whittaker's Adhesive #46960[18] | Polyester | — | Poor |
| Ciba Geigy GY-9513[19]/ Ciba Geigy HY-2964[19] | Epoxy/ Aliphatic amine | — | Poor |

| High Crosslinked Polyurethanes | Type | Adhesion and/or Remarks |
|---|---|---|
| Thermoplastic | Polyurethane | Poor - soft, rubbery |
| Desmodur W[20] | dicyclohexyl | Poor - soft, rubbery |
| Thermoplastic | methyl(4,4')diisocyanate | fair-good iodine resis. |
| Desmodur W | dicyclohexyl methyl(4,4')diisocyanate | Poor - hard, glossy |
| Desmodur N-100[20] | hexamethylene diisocyanate oligomer/catalyst | Poor - soft, rubbery easily marred |
| Desmodur N-3390[20] | hexamethylene diisocyanate oligomer/catalyst | Poor - soft, rubbery easily marred |
| Desmodur N-3390[20] | hexamethylene diisocyanate oligomer/catalyst | Poor - soft, rubbery easily marred |
| Desmodur N-3390/TMDI[21] | hexamethylene diisocyanate oligomer/TMDI/ | 1 day good (soft) 5 days poor (hard) |

TABLE 2-continued

| | | | |
|---|---|---|---|
| Desmodur W3398[20] | | catalyst hexamethylene diisocyanate oligomer/catalyst | Poor - hard, glossy fair-good iodine resis. |
| **Other Seam Coating Candidates** | | **Type** | **Adhesion and/or Remarks** |
| Congo's Seam Coater "Easy Does It" SN-102[22] | | Two part urethane based on an aliphatic diisocyanate | Poor - poor iodine resistance |
| Del Val's Ink Vehicle[23] | | Polyamide - Ethanol/VMP/IPAc[24] 60/20/20 | Poor - yellowed |
| Magic Appliance Touch-Up Paint for Tubs and Sinks (White)[25] | | — | Poor |
| Mobay 0402A[20] | | Aliphatic carboxylated urethane latex | Poor - soft and flexible |
| Spencer Kellogg DV 5546 | | Aliphatic carboxylated urethane latex | Poor - dull film |
| Spencer Kellogg DV5546 | 9 | Aliphatic carboxylated | Gelled on mixing |
| Resimene 717[8] | 1 | Methylated Melamine | in of PTSA |
| PTSA[27] 10% in water | 1 | Catalyst | |
| Rohm and Haas E 2184[1] | | Acrylic latex | Poor - sl. yellow (dried at 30° C.) |
| CDM-WJ55 | 2 | Epoxy | Poor |
| Maincote TL-5[1] | 1 | | |
| Resimene 717[8] | 9 | Methylated melamine | Poor - water |
| PTSA (10% in water) | 1 | Catalyst | re-soluble after 10 days |
| Helastic 6545[28] | | Aliphatic polyurethane | Poor - very poor |
| Ucarlnk XL 225E[4] | | dispersion Carbodiamide | iodine resistance, easily marred |
| Helastic X915[28] | | Aliphatic polyurethane | Poor - poor |
| Xama 7[29] | | dispersion Aziridine | iodine resistance |
| Rhoplex WL-91[1] | | Acrylic latex Tg 52° C. | Good - good iodine |
| BCA[30] | | | resistance, easily marred |
| DER 331/DER 721[31] | | Bisphenol A epoxy | Poor |
| DEH 58 | | Amine hardener | |
| Butvar B-98[8] (20%) | 90 | Polyvinyl butyral | Unsatisfactory |
| Resimene U-983[8] in ethanol/water, 95/5 | 24 | Melamine | |
| PTSA (40%) | 0.75 | Catalyst | |
| Butvar B-98[8] (20%) | 90 | Polyvinyl butyral | Unsatisfactory |
| Resimene 881[8] | 20 | Melamine | |
| PTSA (40%) | 0.75 | Catalyst | |
| Butvar B-98[8] (20%) | 90 | Polyvinyl butyral | Unsatisfactory |
| Resimene 872[8] | 20 | Melamine | |
| PTSA (40%) | 0.75 | Catalyst | |
| Butvar B-98[8] (20%) | 90 | Polyvinyl butyral | Unsatisfactory |
| Resimene U-983[8] | 3 | Melamine | |
| Resimene 872[8] | 20 | Melamine | |
| PTSA (40%) | 0.75 | Catalyst | |
| Butvar B-98[8] (20%) | 90 | Polyvinyl butyral | Unsatisfactory |
| Resimene U-983[8] | 10 | Melamine | |
| Resimene 872[8] | 10 | Melamine | |
| PTSA (40%) | 0.75 | Catalyst | |
| Resimene 747[8] | 20 | Methylated melamine | Unsatisfactory |
| RJ-100[8] | 40 | Styrene allyl alcohol | |
| Toluene/ethanol (1:1) | 60 | | |
| PTSA (40%) | 0.6 | Catalyst | |
| Resimene 747[8] | 20 | Methylated melamine | Unsatisfactory |
| RJ-100[8] | 40 | Styrene allyl alcohol | |
| Toluene/ethanol (1:1) | 60 | | |
| PTSA (40%) | 1.2 | Catalyst | |
| Resimene 2060[8] | 50 | Melamine | Unsatisfactory |
| Toluene/ethanol (2:1) | 30 | | |
| PTSA (40%) | 5 | Catalyst | |
| Resimene 2060[8] | 50 | Melamine | Unsatisfactory |
| Toluene/ethanol | 30 | | |
| PTSA (40%) | 10 | Catalyst | |
| Resimene 745[8] | 10 | Melamine | Unsatisfactory |
| Styrene allyl alcohol | 40 | | |
| Toluene/ethanol (2:1) | 25 | | |
| PTSA (40%) | 5 | Catalyst | |
| Resimene 745[8] | 10 | Melamine | Unsatisfactory |
| Styrene allyl alcohol | 40 | | |
| Toluene/ethanol (2:1) | 25 | | |
| PTSA (40%) | 10 | Catalyst | |
| Gelva GMS 264[32] | | Polyvinyl acetate - | Unsatisfactory |

TABLE 2-continued

| | | | |
|---|---|---|---|
| | | maleate copolymer | |
| Gelva GMS 269[32] | | Polyvinyl acetate - maleate copolymer | Unsatisfactory |
| Gelva GMS 1140[32] | | Polyvinyl acetate - maleate copolymer | Unsatisfactory |
| Gelva GMS 1215[32] | | Polyvinyl acetate - maleate copolymer | Unsatisfactory |
| Gelva GMS 1430[32] | | Polyvinyl acetate - maleate copolymer | Unsatisfactory |
| Gelva GMS 1753[32] | | Polyvinyl acetate - maleate copolymer | Unsatisfactory |
| Gelva GMS 1822U[32] | | Polyvinyl acetate - maleate copolymer | Unsatisfactory |
| Gelva GMS 1151[32]/ PAPI isocyanate[33] | | Polyvinyl acetate - maleate copolymer/catalyst | Unsatisfactory |
| Mirabond[17] | 95 | Polyurethane | Poor |
| KL3-2001[20] | 5 | Bonding agent | |
| Mirabond[17] | 90 | Polyurethane | Poor |
| KL3-2001[20] | 10 | Bonding agent | |
| S-553[17] | 95 | Vinyl sealer | Poor |
| KL3-2001[20] | 5 | Bonding agent | |
| S-553[17] | 90 | Vinyl sealer | Poor |
| KL3-2001[20] | 10 | Bonding agent | |
| Gelva GMS 1151[32] | 95 | PVAC-maleate copolymer | Poor |
| KL3-2001[20] | 5 | Bonding agent | |
| Gelva GMS 1430[32] | 95 | PVAC-maleate copolymer | Poor |
| KL3-2001[20] | 5 | Bonding agent | |
| Epon 828[35] | 50 | Epoxy | Poor |
| Versamide 1540[34] | 17.94 | Amine hardener | |
| Xylene/MIBK[16], 3/1 | 15 | | |
| Epon 828[35] | 50 | Epoxy | Poor |
| Versamide 1540[34] | 17.94 | Amine hardener | |
| KL3-2001[20] | 3.4 | Bonding agent | |
| Xylene/MIBK, 3/1 | 15 | | |
| Butvar B-98[8] (20% in toluene/ethanol, 1/1) | 90 | Polyvinyl butyral | Poor - poor iodine resistance |
| Dyno MB-98[36] (97%) | 15 | Melamine | |
| PTSA (40%) | 0.75 | Catalyst | |
| Butvar B-98[8] (20%) | 90 | Polyvinyl butyral | Poor - poor |
| Dyno MB-98[36] (97%) | 15 | Melamine | iodine resistance |
| PTSA (40%) | 1.5 | Catalyst | |
| Butvar B-98[8] (20%) | 90 | Polyvinyl butyral | Poor - poor |
| Dyno MB-98[36] (97%) | 15 | Melamine | |
| PTSA (40%) | 3.75 | Catalyst | |
| Butvar B-98[8] (20%) | 90 | Polyvinyl butyral | Poor - poor |
| Dyno MB-98[36] (97%) | 15 | Melamine | iodine resistance |
| PTSA (40%) | 7.5 | Catalyst | |
| Dyno MB-98[36] | 21 | Melamine | Poor - poor |
| RJ-100[8] (40% in toluene/ethanol, 1/1) | 100 | Styrene allyl alcohol | iodine resistance |
| PTSA (40%) | 0.6 | Catalyst | |
| Dyno MB-98[36] | 21 | Melamine | Poor - poor |
| RJ-100[8] (40%) | 100 | Styrene allyl alcohol | iodine resistance |
| PTSA (40%) | 1.2 | Catalyst | |
| Resimene 747[8] | 20 | Methylated melamine | Poor - poor |
| RJ-100[8] (40%) | 100 | Styrene allyl alcohol | iodine resistance |
| PTSA (40%) | 7.5 | Catalyst | |
| Resimene 747[8] | 20 | Methylated melamine | Poor - poor |
| RJ-100[8] (40%) | 100 | Styrene allyl alcohol | iodine reistance |
| PTSA (40%) | 15 | Catalyst | |
| Dyno MB-98[36] | 20.6 | Melamine | Poor - poor |
| RJ-100[8] (40%) | 100 | Styrene allyl alcohol | iodine resistance |
| PTSA (40%) | 7.5 | Catalyst | |
| Dyno MB-98[36] | 20.6 | Melamine | Poor - poor |
| RJ-100[8] (40%) | 100 | Styrene allyl alcohol | iodine resistance |
| PTSA (40%) | 15 | Catalyst | |
| Butvar B-76[8] (14% in MEX) | 658.5 | Polyvinyl butyral | Poor - poor |
| Santicizer 8[8] | 7.5 | Plasticizer | iodine resistance |
| Butvar B-76[8] (14%) | 658.5 | Polyvinyl butyral | Poor - poor |
| Santicizer 8[8] | 7.5 | Plasticizer | iodine resistance |
| KL3-2001[20] | 5.0 | Bonding agent | |
| Butvar B-76[8] (14%) | 658.5 | Polyvinyl butyral | Poor - poor |
| Santicizer 8[8] | 7.5 | Plasticizer | iodine resistance |
| KL3-2001[20] | 10.0 | Bonding agent | |
| Butvar B-76[8] (14%) | 658.5 | Polvinyl butyral | Poor - poor |
| Santicizer 160[8] | 7.5 | Plasticizer | iodine resistance |
| Butvar B-76[8] (14%) | 658.5 | Polyvinyl butyral | Poor - poor |
| Santicizer 160[8] | 7.5 | Plasticizer | iodine resistance |
| KL3-2001[20] | 5.0 | Bonding agent | |
| Butvar B-76[8] (14%) | 658.5 | Polyvinyl butyral | Poor - poor |
| Santicizer 160[8] | 7.5 | Plasticizer | iodine resistance |
| KL3-2001[20] | 10.0 | Bonding agent | |

TABLE 2-continued

| | | | |
|---|---|---|---|
| Aroplaz 6065x50[37] | 170.0 | alkyd resin | Poor - poor |
| Aroplaz 2477x65 | 23.1 | alkyd resin | iodine resistance |
| 6% Cobalt naphthenate | 0.67 | | |
| 6% manganese naphthenate | 0.33 | | |
| Xylene | 28.0 | | |
| 45% nonvolatile solids | | | |
| Aroplaz 6065x50[37] | 100 | alkyd resin | Poor - poor |
| 6% Cobalt naphthenate | 0.33 | | iodine resistance |
| 6% manganese naphthenate | 0.17 | | |
| Xylene | 10.61 | | |
| 45% nonvolatile solids | | | |
| Aroplaz 6008x50[37] | 170.0 | alkyd resin | Poor - poor |
| Aroplaz 2477x65[37] | 23.1 | alkyd resin | iodine resistance |
| 6% Cobalt naphthenate | 0.67 | | |
| 6% manganese naphthenate | 0.33 | | |
| Xylene | 28.0 | | |
| 45% nonvolatile solids | | | |
| Aroplaz 6008x50[37] | 100 | alkyd resin | Poor - poor |
| 6% Cobalt naphthenate | 0.33 | | iodine resistance |
| 6% manganese naphthenate | 0.17 | | |
| Xylene | 10.61 | | |
| 45% nonvolatile solids | | | |
| Aroflint 607[38] | 50 | polyester-epoxy | Poor |
| Aroflint 404xx60[38] | 83.33 | polyester-epoxy | |
| Dowanol PMA[31] | 10 | | |
| 69.77% nonvolatile solids | | | |
| Aroflint 607[38] | 50 | polyester-epoxy | Poor |
| Aroflint 252zm160[38] | 83.33 | polyester-epoxy | |
| Dowanol[31] | 10 | | |

[1]Sold by Rohm and Haas Company
[2]Methyl ethyl ketone
[3]Methylene chloride
[4]Sold by Union Carbide Corp.
[5]Dioctyl phthalate
[6]Polyvinyl chloride
[7]Sold by Hercules Inc.
[8]Sold by Monsanto Chemical Co.
[9]Sold by E. I. Du Pont Le Nemours
[10]Tetrahydrofuran
[11]Dimethylformamide
[12]Sold by Firestone Fire & Rubber Company
[13]Sold by B. F. Goodrich Company
[14]Polyvinyl acetate
[15]Hydroxyl
[16]Methyl isobutyl ketone
[17]Sold by Armstrong World Industries, Inc.
[18]Sold by Whittaker Corp.
[19]Sold by Ciba Geigy Corporation
[20]Sold by Mobay Chemical Corp.
[21]Trimethyl hexamethylene diisocyanate
[22]Sold by Congoleum Corp.
[23]Sold by Del Val Ink & Color Inc.
[24]Isopropyl acetate
[25]Sold by Hechinger Co.
[26]Sold by Textron Inc.
[27]Para-toluenesulfonic acid
[28]Sold by Seton Leather Company
[29]Sold by Aerojet-General Corporation
[30]Butyl cellosolve acetate sold by Union Carbide Corp.
[31]Sold by Dow Chemical Company
[32]Sold by Shawinigan Products Corporation
[33]Sold by Carwin Company
[34]Sold by General Mills, Inc.
[35]Sold by Shell Chemical Corporation
[36]A melamine low temperature crosslinker
[37]Sold by Ashland Oil, Inc.
[38]Sold by Spencer Kellogg Cyanoacrylate monomers were the only resinous system that showed adequate adhesion to the wear layer. Table 3 lists the cyanoacrylates and amine accelerators which were evaluated.

TABLE 3

Cyanoacrylates Monomers

| Designation | Cyanoacrylate Ester | Viscosity (CPS) |
|---|---|---|
| Loctite ® 401[1] | Ethyl | 100 |
| Loctite ® 403 | Methoxy ethyl | 1,000 |
| Loctite ® 411 | Modified ethyl | 5,000 |
| Loctite ® 414 | Ethyl | 120 |
| Loctite ® 430 | Methyl | 80 |
| Loctite ® 447 | Ethyl | 600 |
| Loctite ® 460 | Methoxy ethyl | 50 |

TABLE 3-continued

| | | |
|---|---|---|
| Permabond ® 102[2] | Ethyl | 100 |
| Permabond ® 130 | Methyl | 500 |
| Permabond ® 910 | Methyl | 100 |
| Permabond ® 5238-143A | Ethyl + 5% DMP[3] | — |
| Permabond ® 5238-143B | Ethyl + 10% DMP | — |
| Hernon's Instantbond 105[4] | Methyl | 1-5 |
| Hernon's Instantbond 110 | Methyl | 100 |
| Hernon's Instantbond 117 | Ethyl | 1,300-1,700 |
| Hernon's Instantbond 123 | Ethyl | 100-120 |
| Hernon's Instantbond 126 | "Rubber" modified | 2,000 |
| Hernon's Instantbond 127 | "Rubber" modified | 4,000-6,000 |

Cyanoacrylate Accelerators and Primers

| Designation | % Active Ingredient | Composition | Solvent |
|---|---|---|---|
| Loctite | 1.0 | Sulfenamide[5] | 1,1,1-tri- |

TABLE 3-continued

| | | | |
|---|---|---|---|
| Activator 711 | | | chloroethane |
| Loctite Activator 702 | 0.1 | " | 1,1,1,-tri-chloroethane |
| Loctite Activator 703 | 0.1 | " | 1,1,1,-tri-chloroethane |
| Loctite Activator FMD-146 | 1.0 | Modified sulfenamide | Freon 113/ acetone 85/15 |
| Permabond Q.F.S. | 1.0 | DMPT[6] | 1,1,1-tri-chloroethane |
| Permabond 27A | 1.0 | Modified DMPT | 1,1,1-tri-chloroethane |
| Permabond 27B | 1.0 | Phenyl ethyl ethanolamine | 1,1,1-tri-chloroethane |
| Hernon Primer 20 | 1.0 | DMPT | trichloro trifluoro ethane |
| Hernon Primer 22 | 0.5 | DMPT | trichloro trifluoro ethane |

[1]Sold by Loctite Corporation
[2]Sold by National Starch and Chemical Corp.
[3]Dimethyl phthalate
[4]Sold by Hernon Mfg. Inc.
[5]Sold by Vanderbilt Chemical Corp. under the registered trademark Amax
[6]Dimethyl p-toluidine For the adhesion evaluations, the cyanoacrylates were applied to floor coverings having the aminoplast-/polyol wear layer, optionally leveled with an applicator tip and sprayed with various amine accelerators using a hand-operated atomizer. The accelerator was applied ten minutes after the coating composition was applied. Ethyl esters which had a viscosity of approximately 100 CPS were the most promising.

Physical properties of samples prepared at ambient conditions of 75° F. and 34% relative humidity were evaluated. The results are shown in Table 4.

TABLE 4

| Cyanoacrylate | Accelerator or Primer (% active ingredient) | Adhesion | Household[1] Stain Resistance - 3 Hours | Ultra-Violet Discoloration Test 3 days | 5 days |
|---|---|---|---|---|---|
| Loctite 401 | 711 (1.0%) | Chipped off w/difficulty | 000040 | mod[2] | mod |
| " | 702 (.1%) | Good | 000020 | v.sl[3] | v.sl |
| " | 703 (0.01%) | Good | 000020 | v.sl | v.sl |
| " | FMD-146 (experimental) | Good | 000000 | none | none |
| Permabond 102 | Q.F.S. (1%) | Poor | 010040 | severe | severe |
| " | 27A (1%) | Poor | 000040 | none | none |
| " | 27B (1%) | Poor | 020240 | mod | mod |
| Permabond 143A | Q.F.S. (1%) | Poor | 010240 | severe | severe |
| " | 27A (1%) | Poor | 010340 | none | none |
| " | 27B (1%) | Poor | 000340 | mod | mod |
| Hernon 123 | Primer 20 (1%) | Poor | 000030 | none | none |
| " | Primer 22 (0.5%) | Poor | 000030 | none | none |
| Loctite 401 | None | Good | 000010 | v.sl | v.sl |
| Permabond 102 | None | Good | 000030 | none | none |
| Hernon 123 | None | Good | 000040 | none | none |

[1]Ball Point Pen Ink, Magic Marker, Brown Shoe Polish, Hair Dye, Iodine 3% and Driveway Sealer, respectively. A higher number indicates darker stain.
[2]Moderate
[3]Very slight The use of higher concentration accelerators resulted in poor adhesion because the speed of cure was too fast to allow the monomers to wet-out or penetrate the wear layer surface. If the accelerators were applied to the wear layer surface before the cyanoacrylates, the adhesion was poorer for the same reason. Most of the cyanoacrylates showed good household stain resistance in three hour tests except for iodine. The more severe discoloration generally occurred with the higher concentrations of accelerator.

Further physical property tests were run at 75° F. and 66% relative humidity. The results of these tests are set forth in Tables 5 and 6.

TABLE 5

| Cyanoacrylate | Accelerator or Primer | Frosting | Surface Texture | Adhesion 180° flex 2 days old |
|---|---|---|---|---|
| Loctite 401 | 702 (0.1%) | v. slight | good gloss v. slight shrivel | good |
| Loctite 460 | 702 (0.1%) | v. slight | good gloss v. slight shrivel | good |
| Loctite 430 | 702 (0.1%) | v. slight | good gloss v. slight shrivel | good |
| Permabond 102 | Q.F.S. (1%) | slight | sl. grainy | poor |
| Permabond 143A | Q.F.S. (1%) | slight | gnarled | poor |
| Permabond 143B | Q.F.S. (1%) | slight | sl. grainy | good |
| Instantbond 123 | Primer 20 (1%) | v. sl | good gloss | poor |
| Instantbond 110 | Primer 20 (1%) | v. sl | severe whitening | good |

TABLE 6

| Cyanoacrylate | Accelerator or Primer | General Comments One Day | Adhesion Four Days |
|---|---|---|---|
| Loctite 460 (methoxy ethyl) | 702 (0.1%) | iodine resistance poor, grainy surface | good |
| Loctite 430 (methyl) | 702 (0.1%) | good overall | good |
| Loctite 401 (ethyl) | 702 (0.1%) | sl. grainy, good gloss and iodine resistance | good |
| Permabond 102 (ethyl) | Q.F.S. (1%) | good iodine resistance | poor (pops off) |
| Permabond 5238-143A | Q.F.S. (1%) | iodine worse than Permabond 102 | good |
| Permabond 5238-143B | Q.F.S. (1%) | iodine worse than Permabond 5238-143A | poor (pops off) |
| Instantbond 123 (ethyl) | Primer 20 (1%) | low frosting, no shrivel, iodine OK, adhesion good | poor (pops off) |
| Instantbond 100 | Primer 20 (1%) | grainy, no | good, but |

TABLE 6-continued

| Cyanoacrylate | Accelerator or Primer | General Comments One Day | Adhesion Four Days |
|---|---|---|---|
| (methyl) | | frosting | brittle when rubbed |

Again, at lower accelerator concentrations, the cyanoacrylates exhibited good adhesion.

The cyanoacrylate monomers are very volatile and their vapors can escape from the seam coater bead before curing starts and redeposit alongside of it causing a white "frosted" appearance (chlorsis). To combat this, the surface may be sprayed with a very low solids amine accelerator in trichloroethane or Freon solvents. If the concentration or coverage is too low, "frosting" occurs. If the concentration or coverage is too high, the cure is too rapid leading to distorted gnarled surface textures. If no accelerator is used the surface cures with a dull grainy surface depending on the relative humidity. The "frosting" and the cured cyanoacrylates can be removed from wear layer surface with nitroethane.

Floor coverings were installed with an epoxy adhesive under the seams. In coating with seams with cyanoacrylates, the polyamide hardening agent in the epoxy adhesive remaining on the surface and/or its vapors were present. This caused the cyanoacrylate to cure prematurely resulting in poor adhesion and a whitening in the coating itself. When installed with an aqueous adhesive, the problem did not occur.

Stain resistance was determined on two of the polyurethane coatings (Desmodur W and Desmodur W3398), Loctite 401 and the wear layer without a seam coating. The results are set forth in Table 7.

TABLE 7

| Seam Coater | Asphalt Tracking | | Antioxidant Staining | | Household Staining | | Stain Resistance |
|---|---|---|---|---|---|---|---|
| Desmodur W | 12.4 | + | 4.3 | + | 18.8 | = | 35.5 |
| Desmodur W3398 | 7.5 | + | 4.7 | + | 11.7 | = | 23.9 |
| Loctite 401 | 5.7 | + | 4.5 | + | 3.7 | = | 13.9 |
| Wear Layer | 6.7 | + | 6.8 | + | 1.6 | = | 15.1 |

(A lower number indicates less staining).

The two polyurethane coatings were significantly less stain resistant than either the cyanoacrylate monomer coating or the wear layer itself. The cyanoacrylate monomer coating was similar to the wear layer.

As stated previously, 2-ethyl cyanoacrylate is the preferred monomer for use with the aminoplast/polyol wear layer. If the cyanoacrylate is modified by the addition of a phthalic acid ester, and particularly dibutyl phthalate, the cyanoacrylate may be applied to the seam by brush. Further, the phthalic acid ester modified cyanoacrylate more closely matches the wear appearance properties of the aminoplast/polyol wear layer. The dibutyl phthalate modified 2-ethyl cyanoacrylate is sold by National Starch and Chemical Corporation under the designation Permabond BK#5235-149A.

What is claimed is:

1. A method of seam coating a surface covering product having an exposed surface comprising the reaction product of a protective coating composition including an aminoplast and a polyol, the method comprising applying to the seam of the surface covering a seam coating composition comprising cyanoacrylate monomer.

2. The method of claim 1 wherein the cyanoacrylate monomer is selected from the group consisting of methyl 2-cyanoacrylate, ethyl 2-cyanoacrylate, propyl 2-cyanoacrylate, butyl 2-cyanoacrylate, methoxy ethyl 2-cyanoacrylate, methoxy methyl 2-cyanoacrylate, ethoxy methyl 2-cyanoacrylate and ethoxy ethyl 2-cyanoacrylate.

3. The method of claim 2 wherein the cyanoacrylate monomer is selected from the group consisting of methyl 2-cyanoacrylate, ethyl 2-cyanoacrylate and methoxy ethyl 2-cyanoacrylate.

4. The method of claim 1 wherein the seam coating composition comprises at least two cyanoacrylate monomers.

5. The method of claim 1 wherein the seam coating composition further comprises a plasticizer.

6. The method of claim 5 wherein the plasticizer is a phthalic acid ester.

7. The method of claim 6 wherein the phthalic acid ester is about two percent to about thirty percent by weight of the seam coating composition.

8. The method of claim 6 wherein the phthalic acid ester is the esterification product of phthalic acid and an organic group selected from the group consisting of an alkanol comprising two to ten carbon atoms, benzyl alcohol, benzyl alcohol derivatives and mixtures thereof.

9. The method of claim 8 wherein the phthalic acid ester is selected from the group consisting of dibutyl phthalate, dihexyl phthalate, dioctyl phthalate and butyl benzyl phthalate.

10. The method of claim 9 wherein the phthalic acid ester is dibutyl phthalate.

11. The method of claim 1 wherein the seam coating composition is clear after it is cured.

12. The method of claim 1 further comprising applying in accelerator to the uncured seam coating composition.

13. The method of claim 12 wherein the accelerator is an amine.

14. The method of claim 13 wherein the amine is sulfenamide, phenyl($C_1$–$C_6$)alkyl($C_1$–$C_6$)alkanol amine or ($C_1$–$C_8$)alkyl-substituted p-toluidine.

15. The method of claim 14 wherein the amine is selected from the group consisting of N-oxydiethylene benzothiazol-2-sulfenamide, phenyl ethyl ethanol amine and dimethyl p-toluidine.

16. The method of claim 1 wherein the aminoplast is a melamine.

17. The method of claim 16 wherein the melamine is alkyl etherified with alkyl groups comprising 1 to 10 carbon atoms.

18. The method of claim 17 wherein the alkyl groups have 1 to 4 carbon atoms.

19. The method of claim 1 wherein the protective coating composition further comprises a vinyl resin.

20. The method of claim 19 wherein the vinyl resin is selected from the group consisting of VAGH, VAGD, VROH and VYES.

21. The method of claim 1 wherein the seam coating is brushable after application on the seam and prior to being cured.

22. The method of claim 1 wherein the seam coating has a viscosity of about 50 to about 300 CPS at the time of application.

23. The method of claim 22 wherein the seam coating has a viscosity of about 100 CPS at the time of application.

24. A flooring system comprising two floor coverings each having an exposed surface comprising the reaction product of a protective coating composition including an aminoplast and a polyol, said floor coverings having abutting edges forming a seam, and a seam coating applied to the seam comprising cyanoacrylate monomer.

25. The flooring system of claim 24 wherein the cyanoacrylate monomer is selected from the group consisting of methyl 2-cyanoacrylate, ethyl 2-cyanoacrylate, propyl 2-cyanoacrylate, butyl 2-cyanoacrylate, methoxy ethyl 2-cyanoacrylate, methoxy methyl 2-cyanoacrylate, ethoxy methyl 2-cyanoacrylate and ethoxy ethyl 2-cyanoacrylate.

26. The flooring system of claim 24 wherein the seam coating further comprises a plasticizer.

27. The flooring system of claim 24 wherein the aminoplast is a melamine.

28. The flooring system of claim 27 wherein the melamine is alkyl etherified with alkyl groups comprising 2 to 10 carbon atoms.

29. The flooring system of claim 24 wherein the protective coating composition further comprises a vinyl resin.

* * * * *

UNITED STATES PATENT AND TRADEMARK OFFICE

CERTIFICATE OF CORRECTION

PATENT NO. : 4,933,220

DATED : June 12, 1990

INVENTOR(S) : James R. Petzold et al.

It is certified that error appears in the above-identified patent and that said Letters Patent is hereby corrected as shown below:

In the Claims, claim 28, column 16, line 15, the number "2" should read --1--.

Signed and Sealed this

Sixteenth Day of July, 1991

*Attest:*

HARRY F. MANBECK, JR.

*Attesting Officer*

*Commissioner of Patents and Trademarks*